US007758360B2

(12) United States Patent
Lesage et al.

(10) Patent No.: US 7,758,360 B2
(45) Date of Patent: Jul. 20, 2010

(54) ELECTRIC CONNECTOR ASSEMBLY HAVING A DEVICE FOR PROTECTION AGAINST POLLUTION

(75) Inventors: Yves Lucien Tranquille Lesage, Palaiseau (FR); Anthony Lorand, Vernon (FR); Christian Henry Mazelle, Saclay (FR)

(73) Assignee: Hispano Suiza, Colombes (FR)

( * ) Notice: Subject to any disclaimer, the term of this patent is extended or adjusted under 35 U.S.C. 154(b) by 257 days.

(21) Appl. No.: 11/958,770

(22) Filed: Dec. 18, 2007

(65) Prior Publication Data

US 2008/0142637 A1 Jun. 19, 2008

(30) Foreign Application Priority Data

Dec. 19, 2006 (FR) ..... 06 55627

(51) Int. Cl.
*H01R 13/44* (2006.01)

(52) U.S. Cl. ..... 439/147; 439/135

(58) Field of Classification Search ..... 439/135, 439/142, 144, 147, 271; 174/76
See application file for complete search history.

(56) References Cited

U.S. PATENT DOCUMENTS

| | | | | |
|---|---|---|---|---|
| 3,449,706 | A * | 6/1969 | Carissimi | 439/141 |
| 4,076,360 | A | 2/1978 | Singh | |
| 4,245,875 | A * | 1/1981 | Shaffer et al. | 439/144 |
| 4,702,710 | A * | 10/1987 | Dittman et al. | 439/271 |
| 4,784,610 | A * | 11/1988 | Stuart | 439/144 |
| 5,041,000 | A | 8/1991 | Shotey | |
| 6,450,833 | B1 * | 9/2002 | Brown et al. | 439/518 |
| 6,802,725 | B2 * | 10/2004 | Rowland et al. | 439/144 |
| 7,575,450 | B2 * | 8/2009 | Williams et al. | 439/144 |

FOREIGN PATENT DOCUMENTS

| | | |
|---|---|---|
| EP | 1 073 156 A1 | 1/2001 |
| GB | 2 422 731 A | 8/2006 |

* cited by examiner

*Primary Examiner*—Thanh-Tam T Le
(74) *Attorney, Agent, or Firm*—Oblon, Spivak, McClelland, Maier & Neustadt, L.L.P.

(57) ABSTRACT

An electric connector assembly includes a plug having primary contacts and a base having secondary contacts capable of interacting with the primary contacts. The connector assembly also includes a closure flap fixed to the base and capable of pivoting between a closed position in which it closes off an axis to the secondary contacts and an open position in which it frees an access to the secondary contacts to make it possible to connect the plug to the base, and an annular sleeve fixed to an electric cable connected to the plug and capable of being moved between two extreme positions, a bottom position in which it covers the closure flap when the plug and the base are connected and a top position in which it frees an access to the plug.

9 Claims, 5 Drawing Sheets

X
Y
42
44
40
30
14
50
20
10
32
48
36
22
16
12
18
46
24
X
Y 14
42
44
40
46
48
16
30
P 14
42
44
40
36
22
48
34
32
12
30
16
P 14
42
44
40
46
10
12
30
48
34
32
16
P

ELECTRIC CONNECTOR ASSEMBLY HAVING A DEVICE FOR PROTECTION AGAINST POLLUTION

BACKGROUND OF THE INVENTION

The present invention relates to the general field of electric connector assemblies of the type comprising a plug having primary contacts and a base having secondary contacts capable of interacting with the primary contacts. It is aimed more particularly at connector assemblies used in the aviation field, for example those fitted to electric control boxes for thrust reverser, alternators, electric actuators or landing gear.

An electric control box for thrust reverser is designed to equip the thrust reversers of aircraft pods. Typically, such a box comprises an electronic computer which, associated with an electronic power amplifier and an electric motor, makes it possible to control the opening or closing of the thrust reverser by means of electromechanical actuators.

This electric control box comprises electric power or signal connector assemblies allowing it to be connected, on the one hand, to various sensors of the thrust reverser, and on the other hand to the Full Authority Digital Engine Control (FADEC) of the aircraft. In a manner known per se, these electric connector assemblies each comprise a plug having primary contacts and a base having secondary contacts capable of interacting with the primary contacts.

Because of the particular location of the electric control box in the thrust reverser of the pods, certain bases of these connector assemblies have their secondary contacts that are oriented opposite gravity.

When the opposed plug of such a connector assembly is disconnected, it is important for reasons of reliability and length of service life of the connector assembly to prevent any penetration of pollutant foreign bodies (such as fluids or dust) into the base of these connector assemblies.

OBJECT AND SUMMARY OF THE INVENTION

The main object of the present invention is therefore to remedy such a disadvantage by proposing a connector assembly having a device for protection against pollution.

This object is achieved by an electric connector assembly comprising, according to the invention, a closure flap fixed to the base and capable of pivoting between a closed position in which it closes off an access to the secondary contacts and an open position in which it frees an access to the secondary contacts to make it possible to connect the plug to the base, and an annular sleeve fixed to an electric cable connected to the plug and capable of being moved between two extreme positions, a bottom position in which it covers the closure flap when the plug and the base are connected and a top position in which it frees an access to the plug.

The object of the closure flap is to protect the secondary contacts against the intrusion of pollutants when the plug of the connector assembly is disconnected from its base. As for the sleeve, it makes it possible to isolate the closure flap from any contact with the pollutants during its long periods in the open position (that is to say when the plug and the base are connected) and therefore to permanently ensure a "clean" closure of the closure flap. The sleeve also has a role of retaining the closure flap when the latter is in the open position to prevent any damage associated with vibrations. In this way, the connector assembly is perfectly protected in all circumstances against pollution.

According to a particular disposition of the invention, the closure flap is mounted on a pivot with a shaft parallel to a transverse plane of the base so that, in the closed position, the closure flap is substantially parallel to the transverse plane of the base, and in the open position, the closure flap is substantially parallel to a longitudinal plane of the base, and a spring is wound around the pivot in a manner such that the closure flap is kept in its closed position in the absence of force exerted on the latter. Thanks to the presence of the spring, the closure flap closes off the secondary contacts in an "automatic" manner as soon as the plug is disconnected from the base. The protection against pollution is thereby reinforced.

According to another particular disposition of the invention, the closure flap comprises a silicone seal on its inner face so as to provide a sealed obstruction to the secondary contacts of the base when it is in its closed position.

According to one embodiment of the invention, the sleeve has a bell-shaped structure centred on a longitudinal axis of the plug with a removable fastening system at one of its ends in order to fasten it to the electric cable connected to the plug, the opposite end of the sleeve being open and free, and the sleeve is capable of sliding along the electric cable so as to pass from one of its extreme positions to the other. Preferably, such a sleeve comprises a rigid ring at its free end.

According to another embodiment of the invention, the sleeve has a retractable structure centred on a longitudinal axis of the plug with one end attached to the electric cable connected to the plug, the opposite end of the sleeve being open and free, and the sleeve is capable of retracting on itself along the electric cable so as to pass from its bottom position to its top position.

According to yet another embodiment of the invention, the sleeve has a bellows shape centred on a longitudinal axis of the plug with one end attached to the electric cable connected to the plug, the opposite end of the sleeve being open and free, and the sleeve is capable of folding back on itself along the electric cable so as to pass from its bottom position to its top position.

A further subject of the invention is an aircraft pod and a turbomachine comprising at least one electric connector assembly as defined above.

BRIEF DESCRIPTION OF THE DRAWINGS

Other features and advantages of the present invention will emerge from the description given below, with reference to the appended drawings which illustrate an exemplary embodiment thereof having no limiting character. In these figures.

DETAILED DESCRIPTION OF VARIOUS EMBODIMENTS

Figure 1:
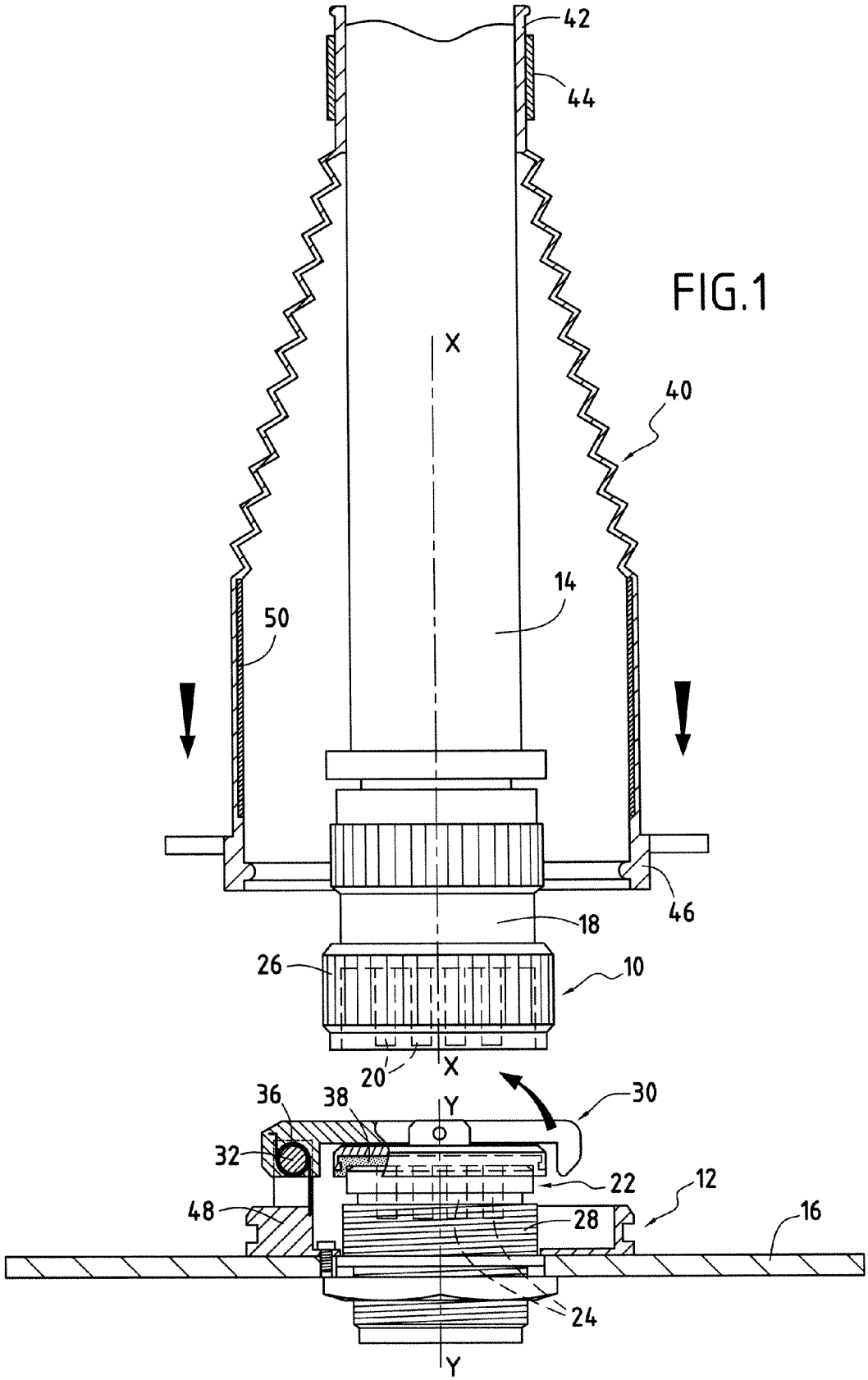
FIGS. 1 and 2 are views in longitudinal section of a connector assembly in two different positions according to a first embodiment of the invention.

FIGS. 1, 2 and 3A to 3C represent very schematically an electric connector assembly according to a first embodiment of the invention.

The connector assembly consists of a plug 10 and a base (or socket) 12. The plug 10 is connected to an electric cable (or harness) 14. As for the base 12, it is designed to be fixed to a wall 16 of an electric box, for example an electric box for the control of a thrust reverser used in the aviation field.

The plug 10 comprises a hollow body 18 of substantially cylindrical shape, with a longitudinal axis X-X and inside which one or more primary contacts 20 are mounted. The base 12 also comprises a hollow body 22 of substantially cylindrical shape, with a longitudinal axis Y-Y and inside which one or more secondary contacts 24 capable of interacting with the primary contacts 20 are mounted.

Interaction between the primary contacts 20 and the secondary contacts 24 means placing in relation for making it possible to establish an electric connection, that is to say the passage of a more or less powerful electric current. Therefore, in the exemplary embodiment of FIGS. 1 and 2, the primary contacts 20 take the form of longitudinal protruding terminals and the secondary contacts 24 each have a hollow tubular shape designed to receive a terminal. Naturally, any other type of primary and secondary contacts making it possible to establish an electric connection can be envisaged.

In order to prevent any inadvertent disconnection between the plug 10 and the base 12 of the connector assembly, the plug may also comprise a ring 26 mounted so as to slide about the cylindrical body 18 of the plug and furnished with an internal thread, this ring being screwed onto a matching external thread 28 of the body 22 of the base when the plug and the base are connected.

According to the invention, the connector assembly also comprises a closure flap 30 that is fixed to the base 12. This closure flap 30 is capable of pivoting between a closed position in which it closes off an access to the secondary contacts 24 (FIGS. 1 and 3A) and an open position in which it frees an access to the secondary contacts in order to make it possible to connect the plug 10 to the base (FIGS. 2, 3B and 3C).

More precisely, the closure flap 30 has a shape of a substantially flat cover with a diameter at least equal to that of the cylindrical body 22 of the base 12. The closure flap is mounted on a pivot 32 articulated about an axis 34 parallel to a transverse plane P of the base (FIGS. 3A and 3B). Therefore, in the closed position, the closure flap 30 is in a plane substantially parallel to the transverse plane P of the base and rests on the cylindrical body 22 of the base in order to close off the latter (FIGS. 1 and 3A). Conversely, in its open position, the closure flap 30 has pivoted by approximately 90° relative to its closed position and is therefore in a plane parallel to a longitudinal plane of the base so as to allow the plug to be connected to the base (FIGS. 2, 3B and 3C). The movement of the closure flap from the closed position to the open position is carried out manually.

Figure 2:
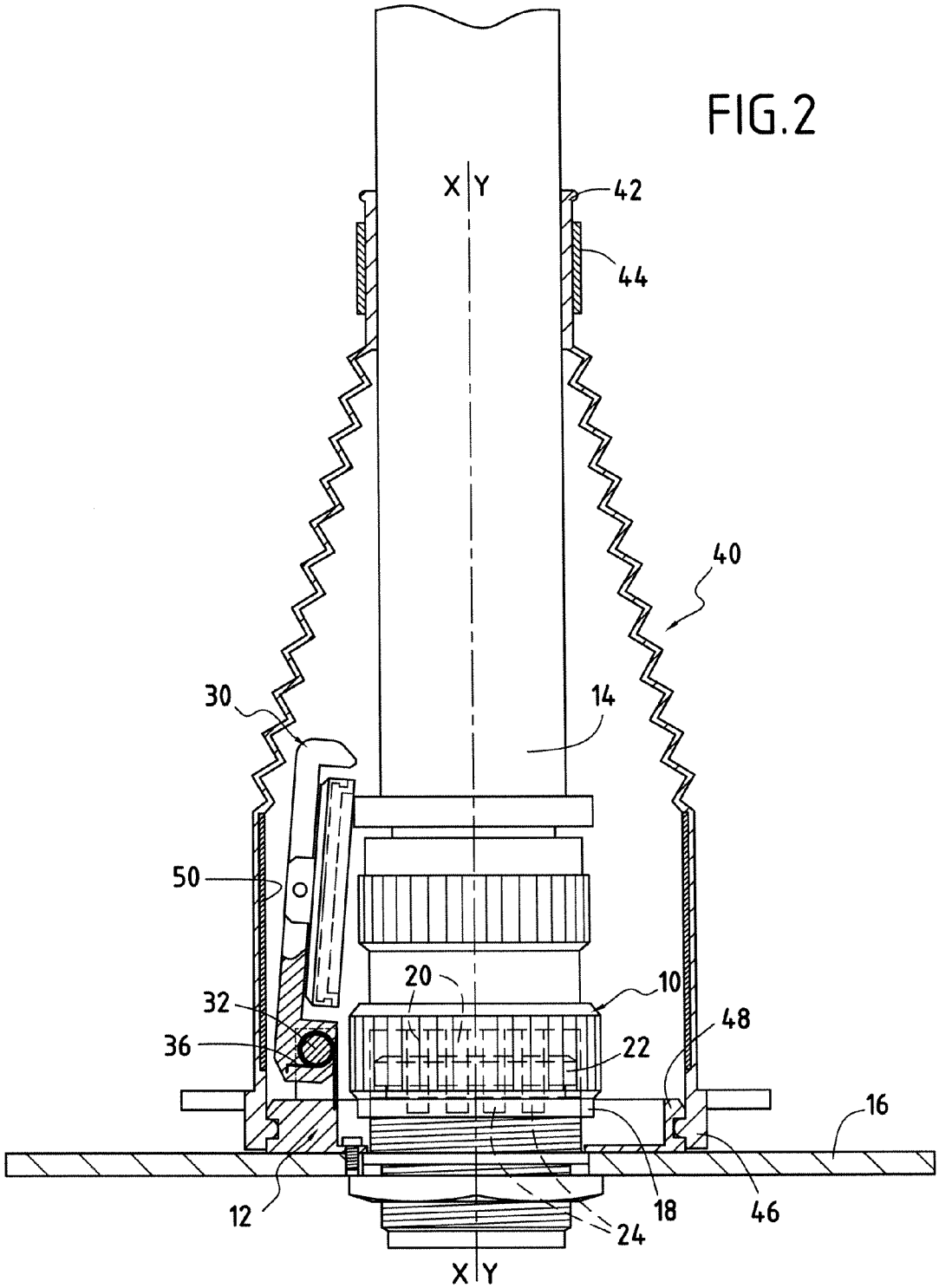
Figures 3A, 3B, 3C:
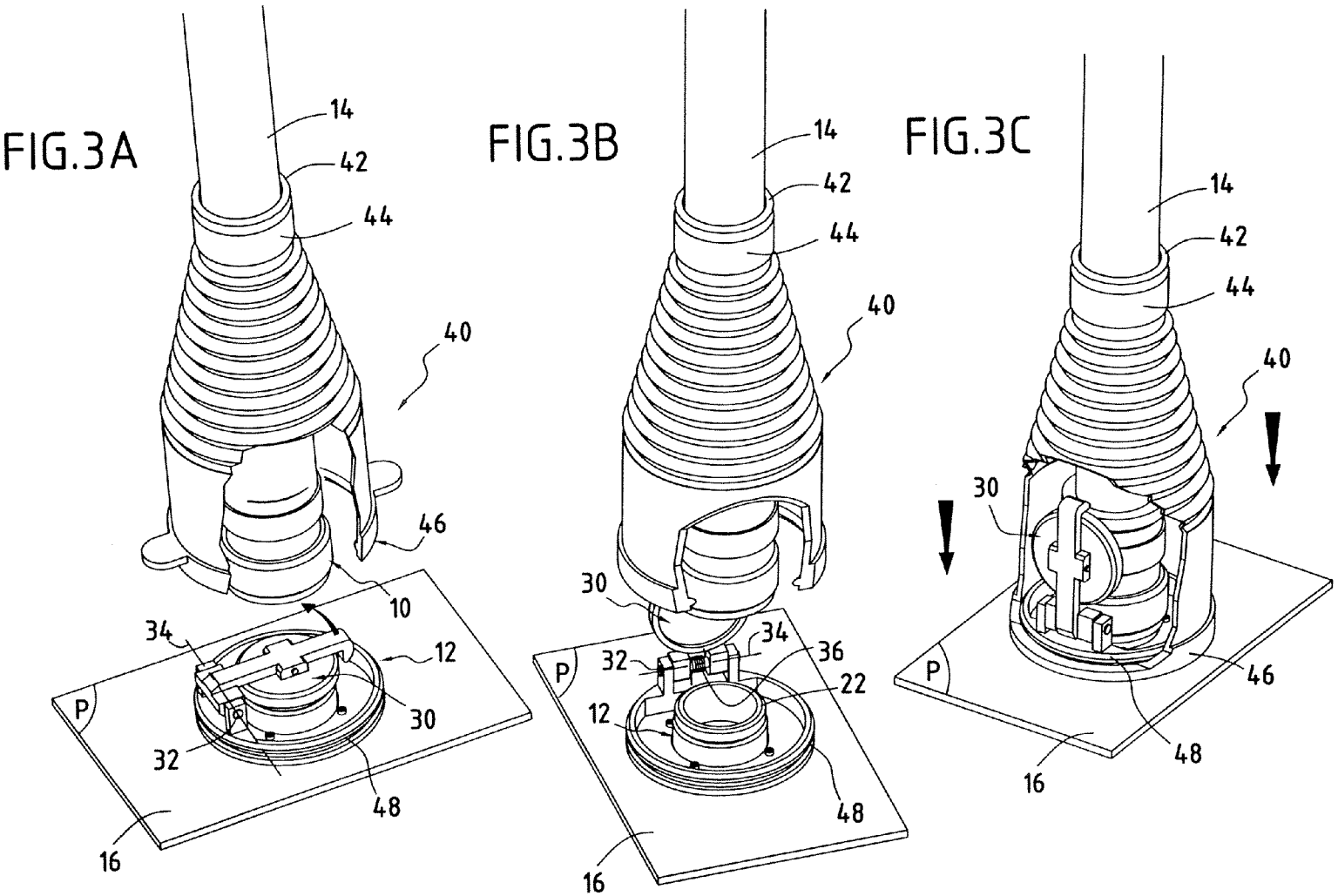
FIGS. 3A to 3C are views in perspective and in partial cut-away of the connector assembly in different positions according to the first embodiment of the invention.

According to an advantageous feature of the invention, a spring 36 is wound around the pivot 32 of the closure flap 30 with one end fixed to the closure flap and the other end fixed to the base (FIGS. 1, 2 and 3B). This spring is wound around the pivot 32 in such a manner that, at rest (that is to say in the absence of force exerted on the closure flap), it holds the closure flap in the closed position. When the closure flap is pivoted to its open position, the spring winds around the pivot 32 and exerts a force on the pivot tending to reclose the closure flap. Accordingly, the closure flap cannot be accidentally left open when the plug 10 and the base 12 of the connector assembly are disconnected.

According to another advantageous feature of the invention, the closure flap 30 also comprises a silicone seal 38 on its inner face (FIG. 1) so as to provide, when it is in its closed position, an obstruction to the secondary contacts 24 of the base 12 that is perfectly sealed.

Still according to the invention, the connector assembly also comprises an annular sleeve 40 fixed to the electric cable 14, connected to the plug 10 and capable of being moved between two extreme positions, a bottom position in which it covers the closure flap 30 when the plug 10 and the base 12 are connected in order to protect the latter against the pollutants (FIGS. 2 and 3C) and a top position in which it frees an access to the plug 10 so as to allow a disconnection of the connector assembly (FIGS. 1, 3A and 3B).

In a first embodiment of the invention illustrated by FIGS. 1, 2 and 3A to 3C, the sleeve 40 has a substantially conical bell-shaped structure made of a flexible or semi-rigid material, such as for example an elastomer.

The bell 40 is more particularly centred on the longitudinal axis X-X of the plug 10 and is able to slide along the electric cable 14 in order to pass from one of its extreme positions to the other. Accordingly, the bell 40 is held at one of its ends 42 on the electric cable 14 by means of a removable fastening system. For example, the fastening system may be a clamping collar 44 that can be loosened. As for the other end 46 of the bell, it is open and free.

The diameter of the free end 46 of the bell is greater than that of its end 42 held around the cable so as to be able to entirely cover the closure flap 30 when the plug and the base are connected. In addition, when the plug and the base are connected, the free end 46 of the bell may advantageously come into contact with a ring 48 concentric with the body 22 of the base, fixed to the wall 16 and with a slightly smaller diameter than the free end 46 of the bell. Such a ring makes it possible to prevent any inadvertent off-centring of the bell relative to the connector assembly.

The operation for connecting the plug 10 to the base 12 evidently derives from the foregoing. The bell 40 is held fixed to the cable 14 in its top position therefore freeing an access to the plug 10. The closure flap 30 is pivoted from its closed position (FIGS. 1 and 3A) to its open position and is held manually in this position to allow the plug to be fitted onto the base (FIG. 3B). Once the plug and the base are connected, the closure flap is released and therefore rests against the plug under the effect of the spring 36 (FIG. 2). The clamping collar 44 of the bell 40 is then loosened and the bell slid along the cable 14 to its bottom position, the free end 46 of the bell engaging around the ring 48 (FIGS. 2 and 3C). The clamping collar of the bell may be tightened again. As for the disconnection operation, it proceeds in the reverse direction.

According to an advantageous feature of this first embodiment shown in FIGS. 1 and 2, the sleeve 40 comprises at its free end 46 a ring 50 made of rigid material (for example of metal). Such a ring 50 is designed to confer rigidity on the cylindrical portion of the sleeve when it is being manipulated.

Figure 4B:
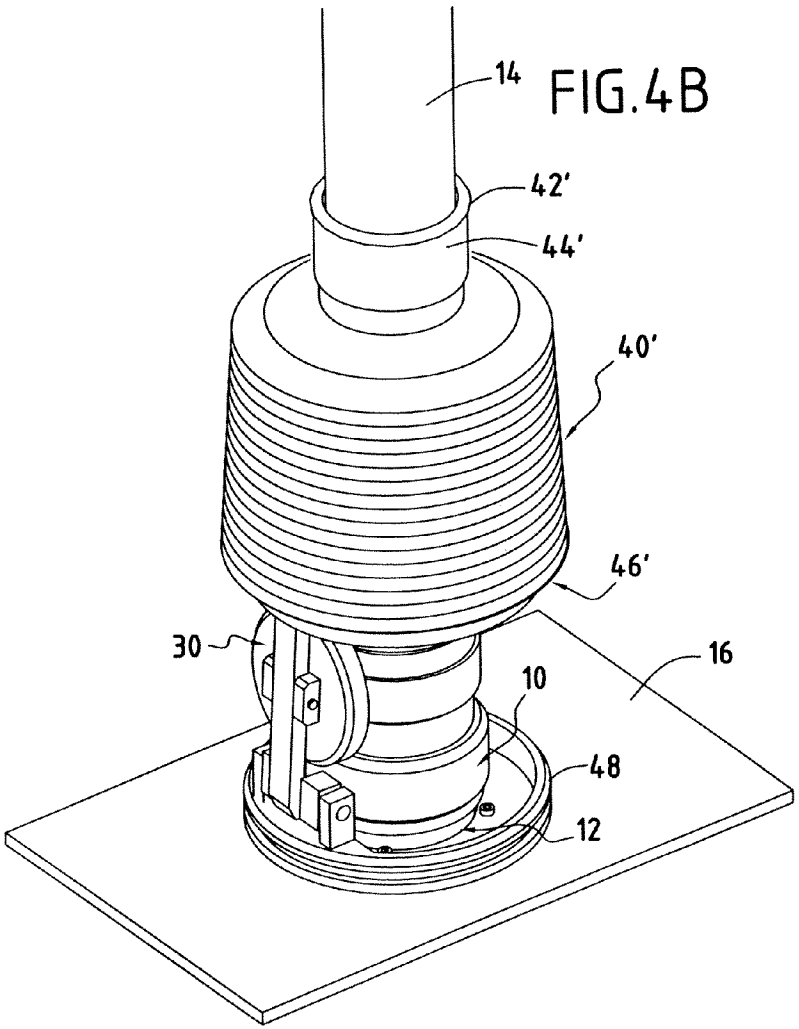
FIGS. 4A and 4B are views in perspective and in partial cut-away of a connector assembly in two different positions according to a second embodiment of the invention.
Figure 4A:
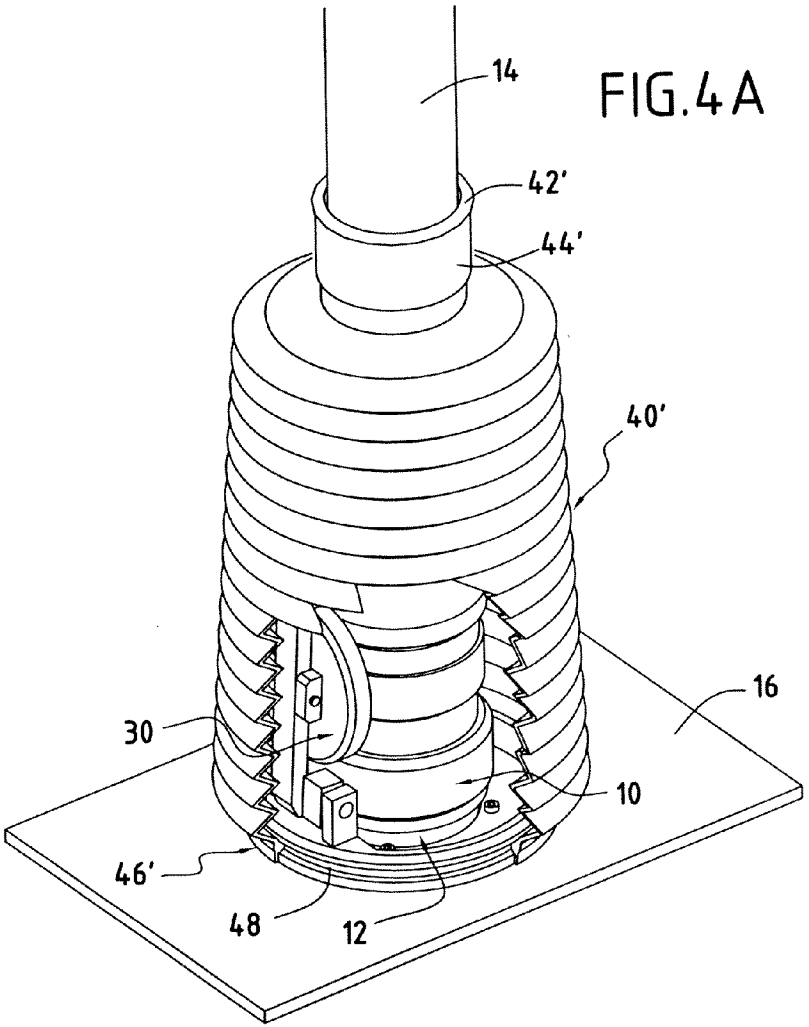

FIGS. 4A and 4B represent a connector assembly according to a second embodiment of the invention. In this embodiment, the plug 10, the base 12 and the closure flap 30 are identical to the first embodiment described above.

The connector assembly also comprises a sleeve 40' fixed to the electric cable 14 connected to the plug 10 and capable of being moved between two extreme positions, a bottom position in which it covers the closure flap 30 when the plug 10 and the base 12 are connected in order to protect the latter against the pollutants (FIG. 4A) and a top position in which it frees an access to the plug 10 so as to allow a disconnection of the connector assembly (FIG. 4B). In this second embodiment, the sleeve 40' has a substantially cylinder-shaped retractable structure made of a flexible or semi-rigid material, such as for example an elastomer.

This retractable structure 40' is centred on the longitudinal axis of the plug with one end 42' fixed around the electric cable 14 by means of a fastener 44', the other end 46' being open and free. The diameter of the free end 46' of the retractable structure 40' is larger than that of its fixed end 42' so as to be able to entirely cover the closure flap 30 when the plug and the base are connected.

In addition, the structure 40' is able to retract on itself along the electric cable so as to pass from its bottom position to its top position. Accordingly, as illustrated in FIGS. 4A and 4B, the sleeve may have a known structure like a bellows retracting accordion-style. Alternatively, the sleeve could have a telescopic structure. The method of operation for connecting and disconnecting this connector assembly is identical to that described with respect to the first embodiment.

Figure 5B:
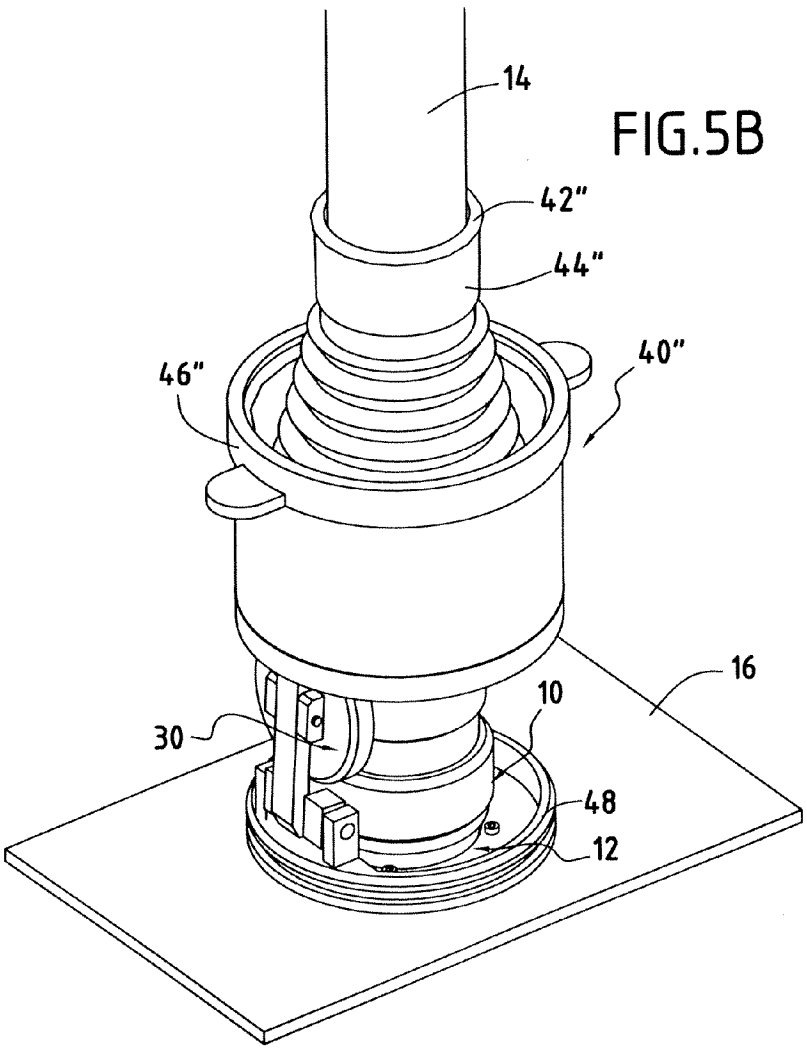
FIGS. 5A and 5B are views in perspective and in partial cut-away of a connector assembly in two different positions according to a third embodiment of the invention.
Figure 5A:
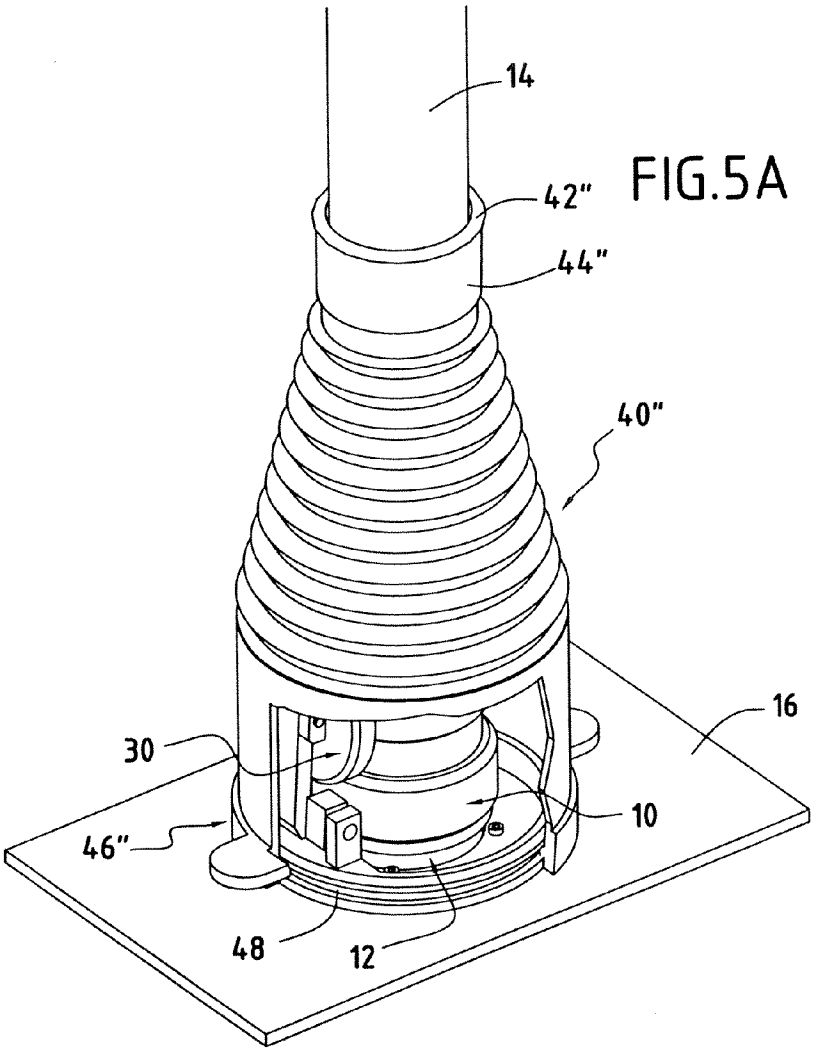

FIGS. 5A and 5B represent a connector assembly according to a third embodiment. In this embodiment, the plug 10, the base 12 and the closure flap 30 are identical to the first embodiment described above.

The connector assembly also comprises a sleeve 40" fixed to the electric cable 14 connected to the plug 10 and able to be moved between two extreme positions, a bottom position in which it covers the closure flap 30 when the plug 10 and the base 12 are connected in order to protect the latter against the pollutants (FIG. 5A) and a top position in which it frees an access to the plug 10 so as to allow a disconnection of the connector assembly (FIG. 5B).

In this embodiment, the sleeve 40" has a substantially conical bellows-shaped structure made of a material such as for example an elastomer.

This structure 40" is centred on the longitudinal axis of the plug with one end 42" fixed around the electric cable 14 by means of a fastener 44", the other end 46' being open and free. The diameter of the free end 46" of the bellows 40" is greater than that of its fixed end 42" so as to be able to entirely cover the closure flap 30 when the plug and the base are connected.

In addition, the bellows 40" is able to fold back on itself along the electric cable 14 so as to pass from its bottom position (FIG. 5A) to its top position (FIG. 5B). Accordingly, the material of which the bellows 40" is made must be sufficiently flexible to allow it to fold back on itself but also have a certain rigidity in order for it to be able to be held without force in its top position. The operating method for connecting and disconnecting this connector assembly is identical to that described with reference to the first embodiment.

The invention claimed is:

1. An electric connector assembly comprising:

a plug having primary contacts and a base having secondary contacts configured to interact with the primary contacts;

a closure flap fixed to the base and configured to pivot between a closed position in which said closure flap closes off an access to the secondary contacts and an open position in which said closure flap frees an access to the secondary contacts to enable the plug to be connected to the base; and an annular sleeve fixed to an electric cable connected to the plug and configured to move between two extreme positions, a bottom position in which said annular sleeve covers the closure flap when the plug and the base are connected and when said closure flap is in said open position, and a top position in which said annular sleeve frees an access to the plug, wherein, in said bottom position, said annular sleeve completely covers the closure flap so as to isolate the closure flap from contact with pollutants when said closure flap is in said open position and when the plug and the base are connected.

2. An assembly according to claim 1, in which:

the closure flap is mounted on a pivot with a shaft parallel to a transverse plane of the base so that, in the closed position, the closure flap is substantially parallel to the transverse plane of the base, and in the open position, the closure flap is substantially parallel to a longitudinal plane of the base, and a spring is wound around the pivot in a manner such that the closure flap is kept in its closed position in the absence of force exerted on the closure flap.

3. An assembly according to claim 1, in which the closure flap comprises a silicone seal on an inner face so as to provide a sealed obstruction to the secondary contacts of the base when the closure flap is in said closed position.

4. An assembly according to claim 1, in which:

the sleeve has a bell-shaped structure centered on a longitudinal axis of the plug with a removable fastening system at one end in order to fasten the sleeve to the electric cable connected to the plug, an opposite end of the sleeve being open and free, and the sleeve is capable of sliding along the electric cable so as to pass from one of said extreme positions to the other.

5. An assembly according to claim 4, in which the sleeve comprises at the free end a rigid ring.

6. An assembly according to claim 1, in which:

the sleeve has a retractable structure centered on a longitudinal axis of the plug with one end attached to the electric cable connected to the plug, an opposite end of the sleeve being open and free, and the sleeve is capable of retracting on itself along the electric cable so as to pass from said bottom position to said top position.

7. An assembly according to claim 1, in which:

the sleeve has a bellows shape centered on a longitudinal axis of the plug with one end attached to the electric cable connected to the plug, an opposite end of the sleeve being open and free, and the sleeve is capable of folding back on itself along the electric cable so as to pass from said bottom position to said top position.

8. An aircraft pod comprising at least one electric connector assembly according to claim 1.

9. A turbomachine comprising at least one electric connector assembly according to claim 1.

* * * * *